US010717580B2

(12) United States Patent
Hudson et al.

(10) Patent No.: US 10,717,580 B2
(45) Date of Patent: Jul. 21, 2020

(54) STORAGE CONTAINER

(71) Applicant: THE SHERWIN-WILLIAMS COMPANY, Cleveland, OH (US)

(72) Inventors: Richard D. Hudson, Cleveland, OH (US); James J. Johnson, Cleveland, OH (US); Gustavo A. Morales, Cleveland, OH (US)

(73) Assignee: the sherwin-williams company, Cleveland, OH (US)

( * ) Notice: Subject to any disclaimer, the term of this patent is extended or adjusted under 35 U.S.C. 154(b) by 22 days.

(21) Appl. No.: 15/431,047

(22) Filed: Feb. 13, 2017

(65) Prior Publication Data

US 2017/0233160 A1 Aug. 17, 2017

Related U.S. Application Data

(60) Provisional application No. 62/294,605, filed on Feb. 12, 2016, provisional application No. 62/311,007,
(Continued)

(51) Int. Cl.
*B65D 77/06* (2006.01)
*B65D 47/12* (2006.01)
(Continued)

(52) U.S. Cl.
CPC ..... *B65D 77/068* (2013.01); *B44D 3/12* (2013.01); *B65D 5/001* (2013.01); *B65D 5/02* (2013.01);
(Continued)

(58) Field of Classification Search
CPC ..... B65D 77/068; B65D 25/14; B65D 5/02; B65D 5/001; B65D 25/28;
(Continued)

(56) References Cited

U.S. PATENT DOCUMENTS 4,356,930 A * 11/1982 Roper ..... B65D 11/26 206/508
4,444,355 A 4/1984 Cary
(Continued)

FOREIGN PATENT DOCUMENTS

AT 343040 10/1978
DE 7023972 6/1970
(Continued)

OTHER PUBLICATIONS

Machin, Alec, Decorate Paints—Alec Machin Design, company website, <http://www.alecmachindesigns.com/decorate-paints/>, UK, accessed Mar. 23, 2016.
(Continued)

*Primary Examiner* — Paul R Durand
*Assistant Examiner* — Robert K Nichols, II
(74) *Attorney, Agent, or Firm* — Tucker Ellis LLP; Carlos Garritano

(57) ABSTRACT

Provided is a storage container for storing a coating material including a container body having first and second ends, a receptacle disposed within the container body, an end cap attached to the container body at the first end and including a base and a collar projecting upward from the base in a first direction that defines a through passage in communication with the receptacle, and a lid removably coupled to the collar of the end cap, the lid including a carrying handle extending in a second direction perpendicular to the first direction and a pour spout adjacent an edge of the lid that defines a through passage in communication with the through passage of collar and the receptacle.

17 Claims, 16 Drawing Sheets

Related U.S. Application Data filed on Mar. 21, 2016, provisional application No. 62/332,650, filed on May 6, 2016, provisional application No. 62/400,849, filed on Sep. 28, 2016.

(51) Int. Cl.

| | |
|---|---|
| ***B65D 8/00*** | (2006.01) |
| ***B65D 51/24*** | (2006.01) |
| ***B44D 3/12*** | (2006.01) |
| ***B65D 5/00*** | (2006.01) |
| ***B65D 5/02*** | (2006.01) |
| ***B65D 25/28*** | (2006.01) |
| ***B65D 43/02*** | (2006.01) |
| ***B65D 47/06*** | (2006.01) |

(52) U.S. Cl.

CPC ..... *B65D 15/22* (2013.01); *B65D 25/28* (2013.01); *B65D 43/02* (2013.01); *B65D 47/06* (2013.01); *B65D 47/122* (2013.01); *B65D 51/242* (2013.01); *B65D 77/062* (2013.01); *B65D 2525/283* (2013.01)

(58) Field of Classification Search

CPC .... B65D 2543/00435; B65D 2501/009; B65D 23/06; B65D 43/0225; B65D 47/122; B65D 25/48; B65D 25/40; B65D 1/18; B65D 1/20; B65D 23/102; B65D 25/2897; B65D 21/022; B65D 21/0223; B65D 21/0219; B65D 21/0217; B65D 21/00; B65D 21/02; B65D 21/0209; B29C 66/542; Y10S 220/05; B44D 3/127

USPC ..... 222/107, 105, 566, 575, 571, 143

See application file for complete search history.

(56) References Cited

U.S. PATENT DOCUMENTS

| | | | | |
|---|---|---|---|---|
| 5,211,304 | A * | 5/1993 | Stolzman | B65D 39/082 220/304 |
| D393,999 | S | 5/1998 | Gruenbacher et al. | |
| D474,682 | S | 5/2003 | Berman | |
| D474,683 | S | 5/2003 | Berman | |
| D489,605 | S | 5/2004 | Berman | |
| 7,032,756 | B2 * | 4/2006 | Wylie | B65D 1/18 206/508 |
| D532,703 | S | 11/2006 | Wild | |
| 7,175,051 | B2 * | 2/2007 | McLelland | B44D 3/12 215/344 |
| D465,726 | C1 | 1/2008 | Tet | |
| D563,797 | S | 3/2008 | McMorris | |
| D583,255 | S | 12/2008 | Castor | |
| D585,763 | S | 2/2009 | Friebe et al. | |
| D599,676 | S | 9/2009 | Friebe et al. | |
| 9,290,310 | B2 | 3/2016 | Sinn et al. | |
| 2003/0059347 | A1 * | 3/2003 | Ostgaard | B01L 3/50825 422/400 |
| 2006/0021995 | A1 * | 2/2006 | Lavin | B44D 3/12 222/105 |
| 2006/0094578 | A1 | 5/2006 | Dammers | |
| 2013/0105432 | A1 * | 5/2013 | Paredes | B65D 23/102 215/40 |
| 2013/0306497 | A1 * | 11/2013 | Llewellyn | B44D 3/12 206/1.7 |
| 2014/0263304 | A1 * | 9/2014 | Guertin | B65D 3/04 220/4.28 |
| 2014/0263338 | A1 | 9/2014 | Stolzman et al. | |
| 2016/0272388 | A1 * | 9/2016 | Slack | B65D 25/14 |

FOREIGN PATENT DOCUMENTS

| | | |
|---|---|---|
| DE | 8915428 | 11/1990 |
| EP | 0 162 727 A2 | 11/1985 |
| EP | 0161909 | 11/1985 |
| EP | 0522326 | 1/1993 |
| FR | 2534880 | 4/1984 |
| WO | 2009023691 | 2/2009 |
| WO | 2013036820 | 3/2013 |

OTHER PUBLICATIONS

Muoio, Danielle, "Redesiging the Paint Can to Save Millions of Gallons of Paint", Bloomberg Business, Aug. 8, 2014, US <https://www.bloomberg.com/news/articles/2014-08-08/redesigning-paint>, accessed Mar. 23, 2016.

PCT/US17/17663—International Search Report and the written Opinion of the International Searching Authority—dated Mar. 23, 2017.

* cited by examiner

STORAGE CONTAINER

RELATED APPLICATIONS

This application claims priority to and the benefit of U.S. Provisional Application Ser. No. 62/294,605 filed on Feb. 12, 2016, U.S. Provisional Application Ser. No. 62/311,007 filed on Mar. 21, 2016, U.S. Provisional Application Ser. No. 62/332,650 filed on May 6, 2016, and U.S. Provisional Application Ser. No. 62/400,849 filed on Sep. 28, 2016. The entirety of which are incorporated herein by reference.

BACKGROUND

The most common way to store coating materials (e.g., paints, stains, varnishes, chemicals, etc.) is a metal can having a metal removable lid, wherein the can has a circular shape. In use, a prying tool is used to remove the lid and the paint is stirred and dispensed from the can. Alternatively, a brush can be dipped directly into the can and the brush is used to apply the coating material to an object. Most metal cans, such as steel paint cans, are moved and carried using a bail made from a steel wire and mounted on opposite sides of the container.

Conventional paint cans have numerous drawbacks. First, removal of the lid can be difficult because a prying tool is required. A lid removal tool is fairly efficient, but often a screwdriver is used instead making the task more difficult. Replacement of the lid is also difficult in that a hammer or mallet is required to completely reseat opposed mating grooves on the lid and container. More often than not, individuals step on the top of the can to press the lid into place. This can be hazardous by possibly causing physical injury, damage to the metal paint can, or spillage of the coating material stored in the metal paint can.

TECHNICAL FIELD

Embodiments of the subject matter disclosed herein relate to a storage container, and more particularly a storage container for a coating material.

BRIEF DESCRIPTION

In an embodiment, a storage container for storing a coating material is provided. The storage container includes a container body having a polygonal shape, which may be an octagonal shape in an embodiment. The container body includes a side wall having first and second ends and a recess at the second end for receiving a lid of another storage container to facilitate stacking of the storage container and the another storage container. The storage container also includes an end cap attached to the container body at the first end and including a base and a collar projecting upward from the base, and a lid removably coupled to the collar of the end cap. The lid includes a carrying handle extending in a second direction perpendicular to the first direction and a pour spout adjacent an edge of the lid that defines a through passage in communication with the receptacle.

BRIEF DESCRIPTION OF THE DRAWINGS

Reference is made to the accompanying drawings in which particular embodiments and further benefits of the provided subject matter are illustrated as described in more detail in the description below.

DETAILED DESCRIPTION

Figure 2:
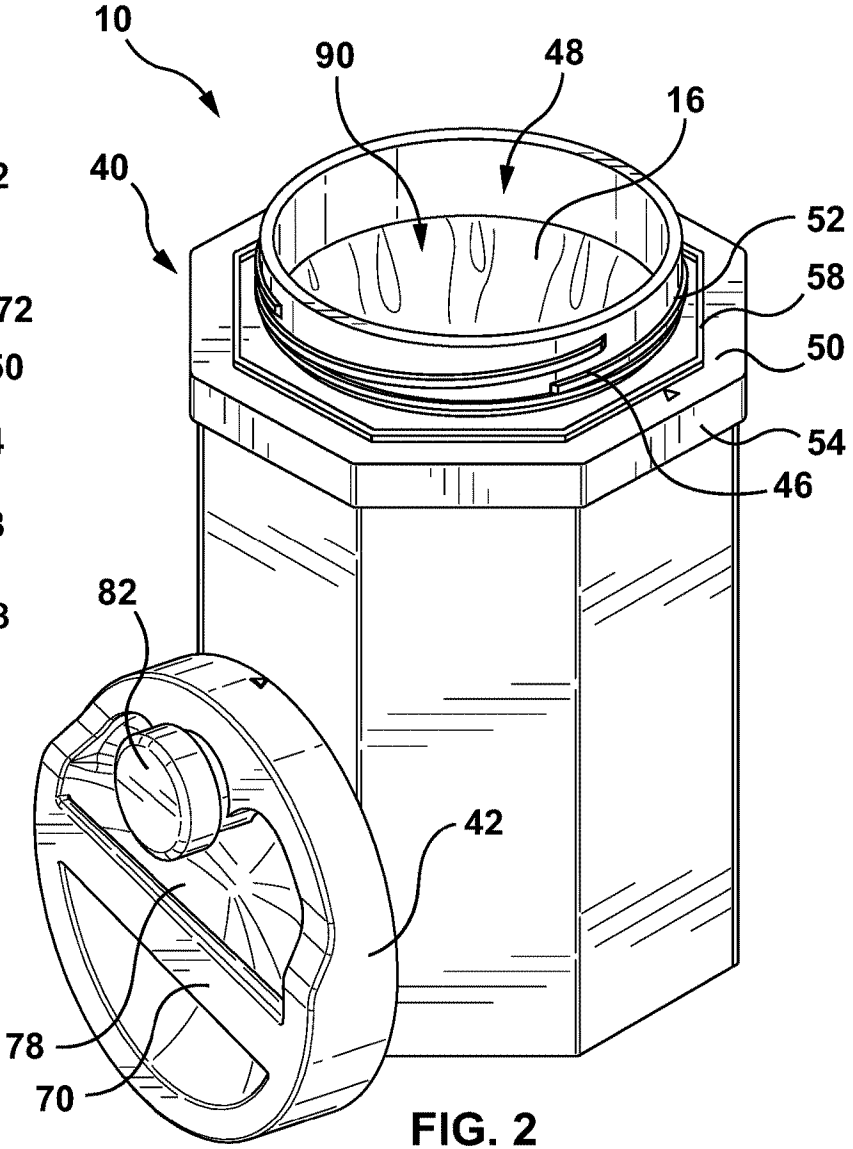
FIG. 2 is another perspective view of the storage container.
Figure 1:
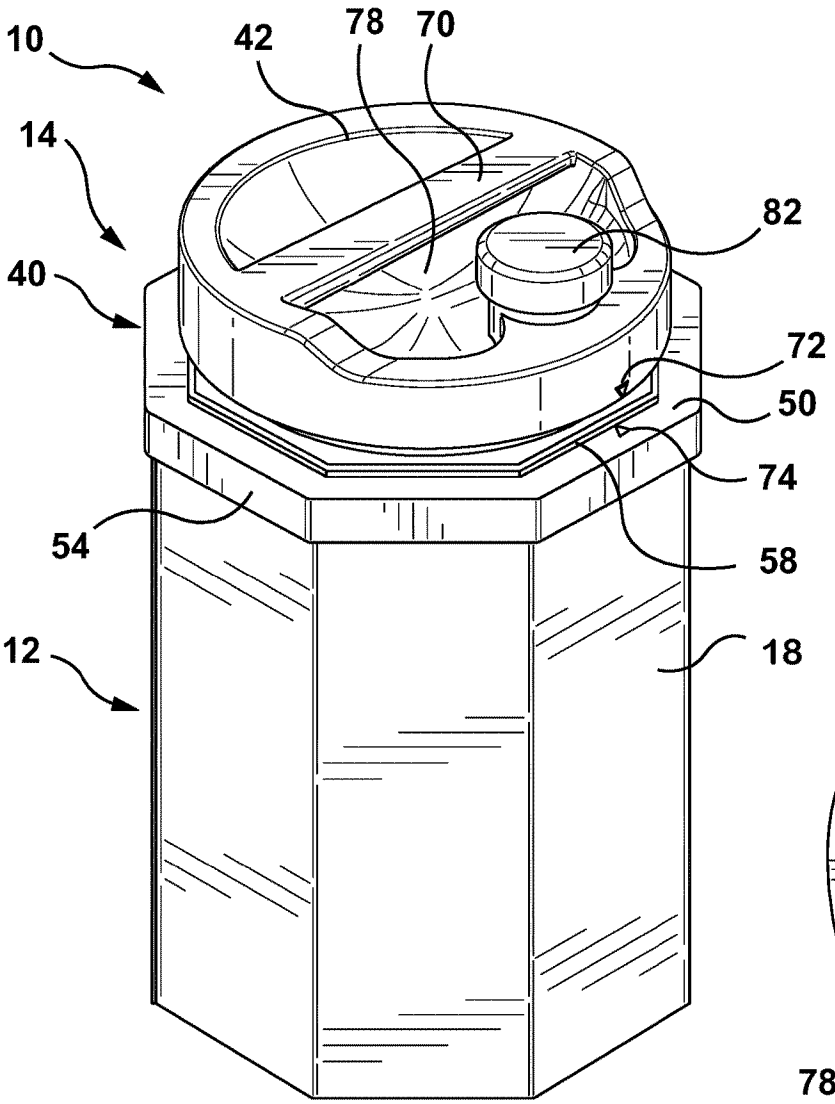
FIG. 1 is a perspective view of an embodiment of a storage container.
Figure 3:
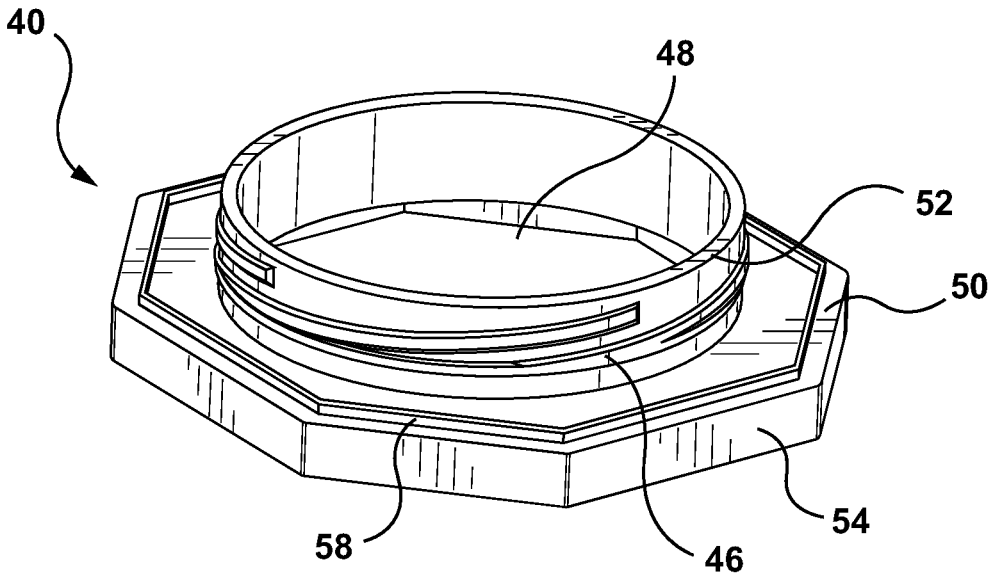
FIG. 3 is a perspective view of an end cap of the storage container.
Figure 4:
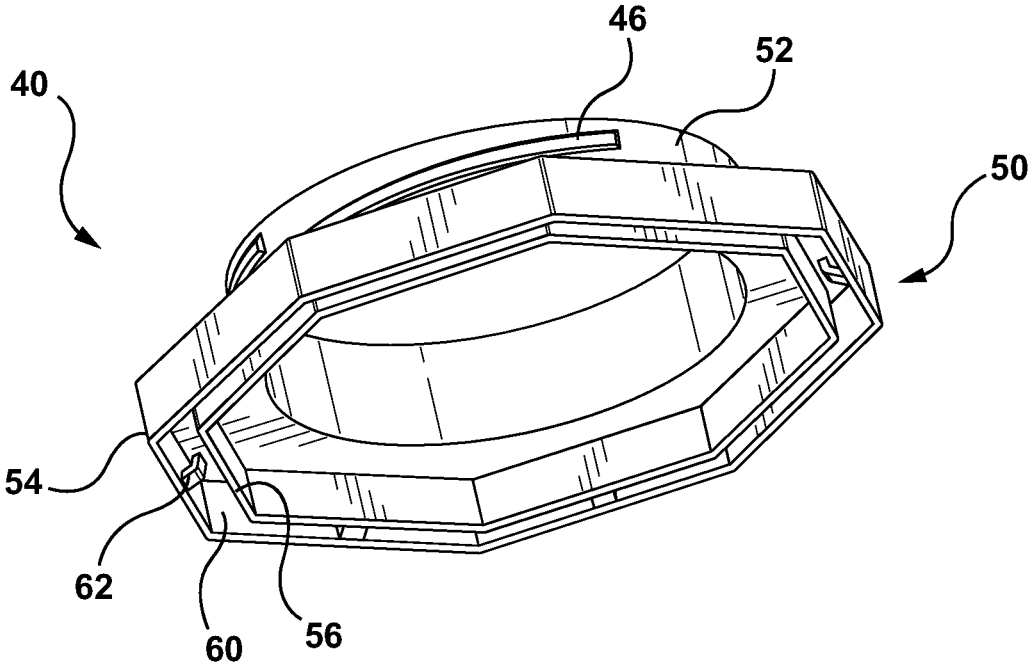
FIG. 4 is another perspective view of the end cap.
Figure 5:
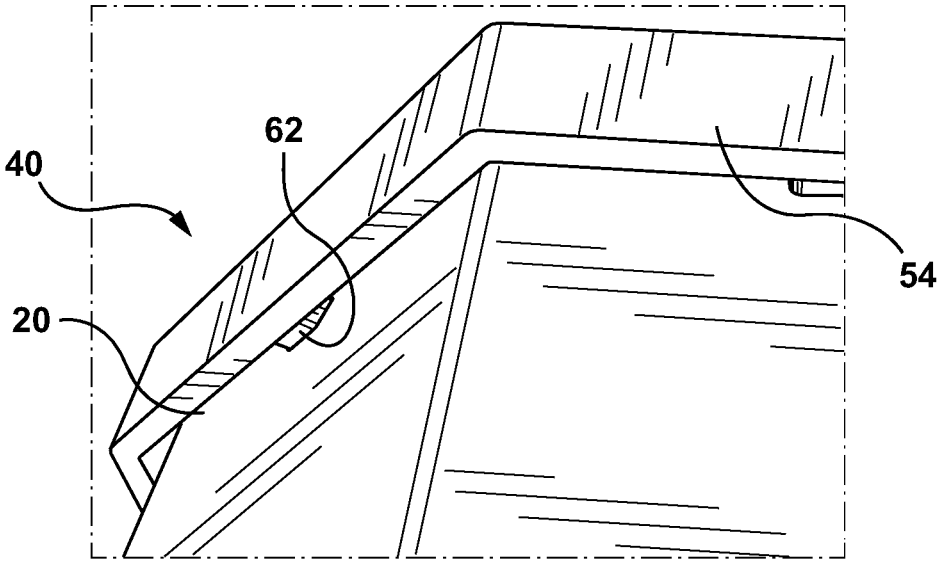
FIG. 5 is a partial view of a container body and the end cap of the storage container.
Figure 6:
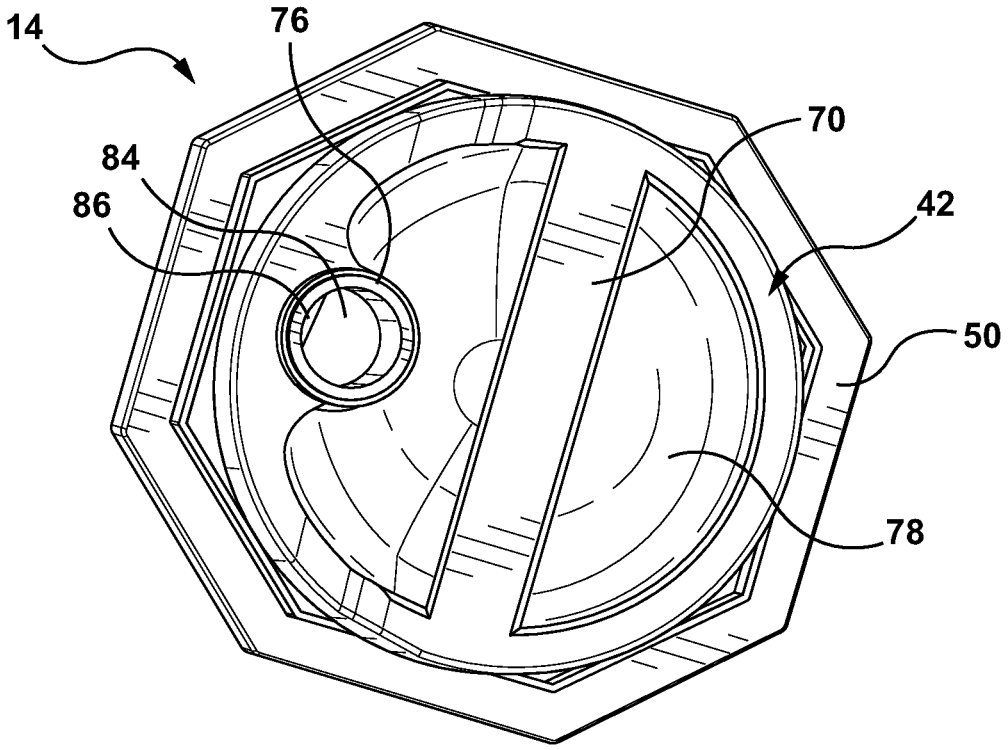
FIG. 6 is a perspective view of a lid assembly.
Figure 7:
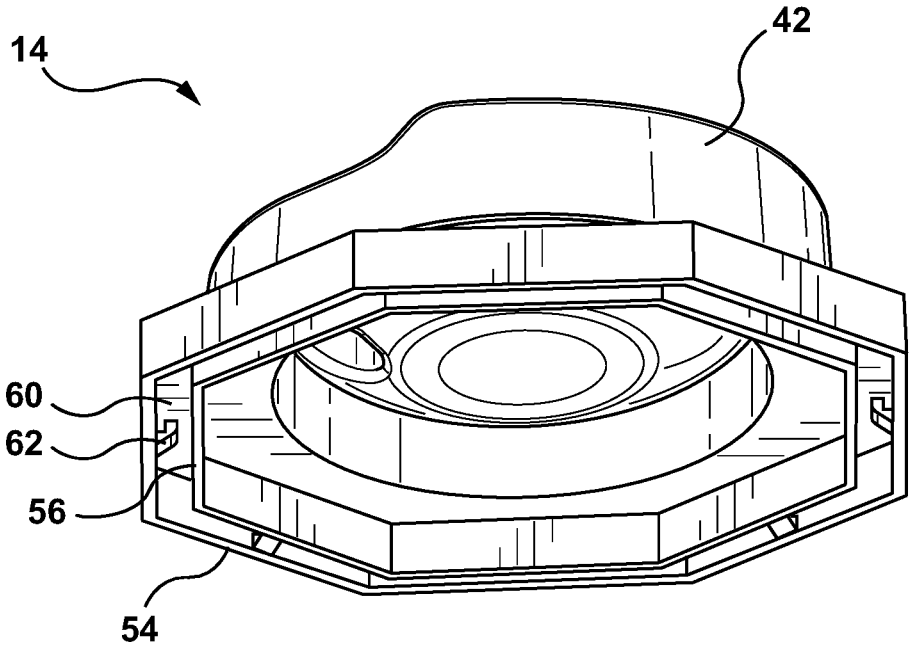
FIG. 7 is another perspective view of the lid assembly.

Embodiments of the provided subject matter relate to a storage container for storing a coating material having a container body with a polygonal shape, such as an octagon container body made of corrugated cardboard. The container also includes a receptacle disposed within the container body and a lid assembly attached to the container body and including an end cap and a lid removably coupled to the end cap. The end cap includes a base and a collar projecting upward from the base in a first direction defining a through passage in communication with the receptacle. The lid includes a carrying handle extending in a second direction perpendicular to the first direction and a pour spout adjacent an edge of the lid that defines a through passage in communication with the through passage of collar and the receptacle.

With reference to the drawings, like reference numerals designate identical or corresponding parts throughout the several views. However, the inclusion of like elements in different views does not mean a given embodiment necessarily includes such elements or that all embodiments of the invention include such elements.

Referring to FIGS. 1-9 a storage container is illustrated generally at reference numeral 10. The storage container 10 includes a container body 12, a lid assembly 14 attached to the container body 12, and a receptacle 16 attached to the lid assembly 14 and disposed within the container body 12. The container body 12 may be any suitable shape, such as a polygonal shape, and in the illustrated embodiment, octagonal in shape. The container body 12 may be made out of any suitable material, such as a corrugated structure such as cardboard, plastic, metal, etc., and may include a suitable coating, such as a RPET laminate or UV varnish.

The container body 12 has a wall 18, shown as an eight sided wall, with a first open end 20 coupled to the lid assembly 14 and a second open end 22, and a bottom portion 24 coupled to, formed with, or otherwise held in position relative to an inner surface 26 of the wall 18. The bottom portion 24 is proximate the second end 22 and defines with the inner surface 26 of the wall 18 a cavity 28 shown in FIG. 8, otherwise referred to as a raised bottom, that facilitates stacking or nesting of containers and provides a lip around the edge at the second end 22 serving as a grip to aid in pouring. As shown in FIG. 9, the container body 12 can include an optional ring 30 at the second end 22, such as a plastic or rubber ring extending around the perimeter of the wall 18. The ring 30 can extend along an outer surface 32 of the wall 18 at the second end 22, along a bottom of the wall 18, and/or along the inner surface 26 of the wall 18 to protect the wall 18 from moisture and add integrity to the wall 18.

Figure 8:
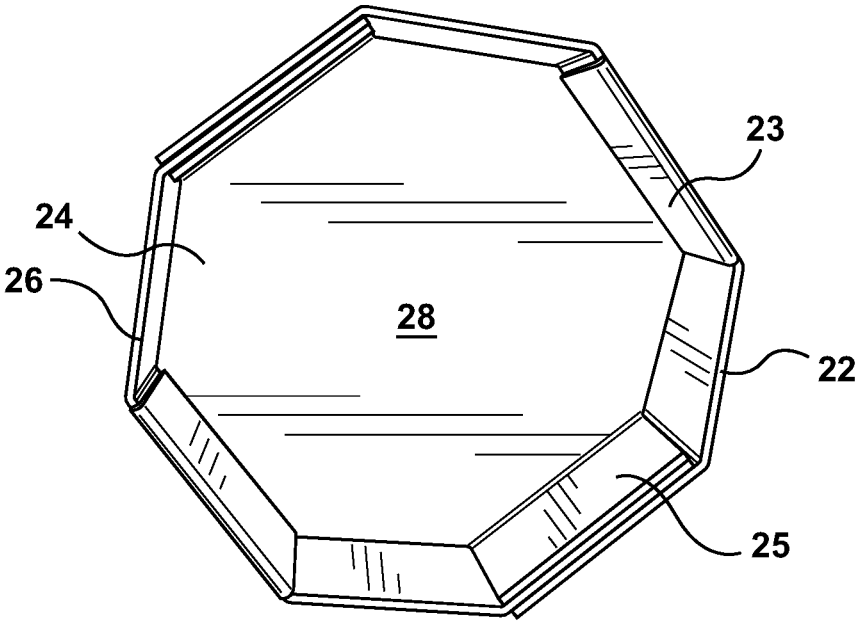
FIG. 8 is a bottom view of the storage container.
Figure 9:
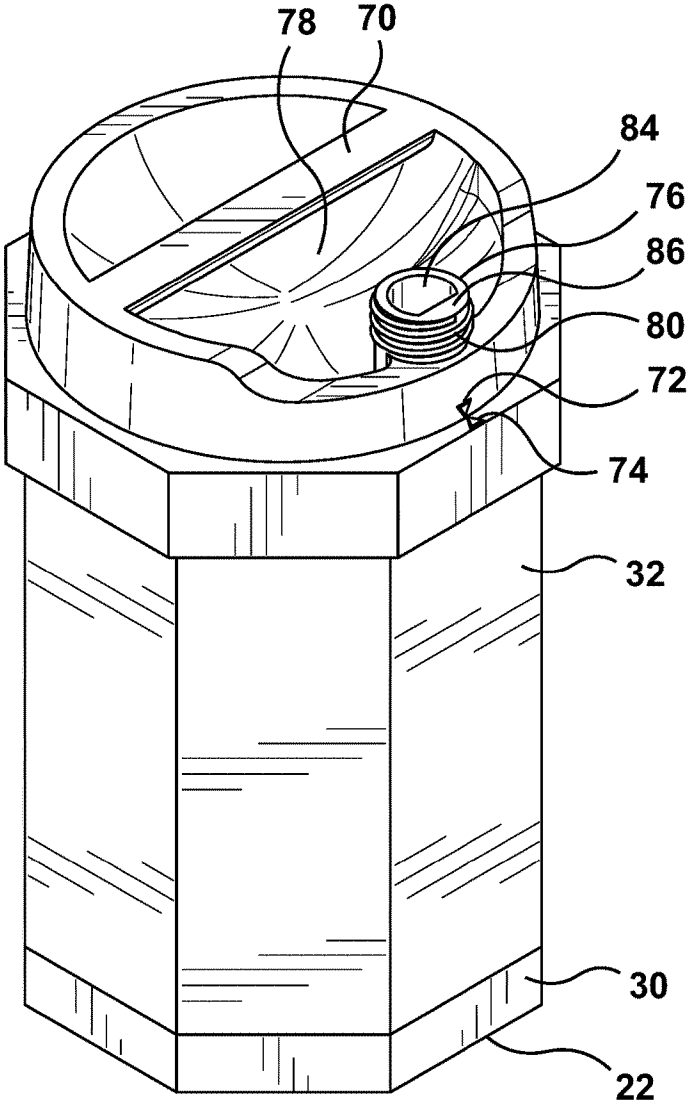
FIG. 9 is another perspective view of the storage container.

In an embodiment, as shown in FIG. 8, the container body 12 can have ten wall segments, where two segments overlap another two segments when the container body is formed to form the eight sided wall, and the overlapping segments can be secured in any suitable manner, such as adhesive. One or more of the segments can be attached to a spacer 23 at the second end 22 and the spacer is also attached to the bottom portion 24. When assembled, the spacer 23 abuts the inner surface 26 of the wall 18 to space the bottom portion 24 from the second end 22. Supports 25 can also be attached to two sides of the bottom portion 24 and configured to be secured to the inner surface 26.

Turning now to the lid assembly 14, the lid assembly 14 includes an end cap 40 and a lid 42 removably coupled to the end cap 40, such as by threads on an inner surface of the lid 42 that mate with threads 46 on an outer surface of the end cap 40. The end cap 40 includes a base 50, a collar 52 projecting upward from the base 50 and having the threads 46 and defining a through passage 48 in communication with the receptacle 16, and inner and outer skirts 54 and 56 extending downwards from the base 50. The base 50 can also include a raised structure 58 on a top side thereof. By way of example and not limitation, the raised structure 58 can be a rib or feature that has the same polygonal shape as the container body 12 and base 50 to match into the bottom side of another storage container when stacked. The raised structure 58 can facilitate strength of coupling when fit together with another storage container or when stacking storage containers.

The base 50 may be any suitable shape, such as a polygonal shape, and in the illustrated embodiment, octagonal shape, and the collar 52 may be any suitable shape corresponding to the shape of the lid 42, such as a circular shape. The outer skirt 54 projects downward along a periphery of the base 50 and follows the geometry of the base 50, and the inner skirt 56 is radially inwardly spaced from the outer skirt 54 and projects downward following the geometry of the base 50, although it will be appreciated that the inner skirt 56 may have other suitable geometries as discussed below. The base 50, collar 52, and inner and outer skirts 54 and 56 may be integrally formed of a suitable material, such as plastic.

The outer and inner skirts 54 and 56 form therebetween and with the base 50 a channel 60 for receiving the first end of the wall 18. In an embodiment, the first end 20 of the wall may be coupled to the end cap 40 by a friction fit and lock to the end cap 40, such as by a plurality of attachment tabs 62 projecting inward from the outer skirt 54. The illustrated embodiment shows six attachment tabs 62 provided on six separate sides of the eight sided skirt 54, for example centered on the sides, although any suitable number of tabs in any suitable arrangement may be provided. The attachment tabs 62 bite into the outer surface 32 of the wall 18 at the first end 20 to secure the container body 12 to the end cap 40 and prevent removal of the wall 18, although it will be appreciated that other suitable attachment methods may be used in addition to or as an alternative to the attachment tabs, such as adhesive, fasteners, etc.

Referring now to the lid 42 in detail, the lid 42 may be made of any suitable material, such as plastic, and may include a carry handle 70, an alignment marker 72 that aligns with a corresponding alignment marker 74 on the base 50 of the end cap 40, and a pour spout 76 provided near an edge of the lid 42. The lid 42 defines a cavity 78 below the carry handle 70 to provide a space for a user's hand. The handle 70 is a full-grip handle that allows the container 10 to be carried by the closure while eliminating the need for a bail and/or handle on container body 12. The handle 70 assists in carrying, opening, and pouring functions. In an embodiment, the container body 12 does not include holes, handles or openings that would suggest vulnerability of the receptacle 16, such as an integral handle and/or a bail-type handle secured thereto. The alignment markers 72 and 74 can be any suitable symbol or indicator that when aligned indicate that the lid 42 is secured to the collar 52 in a closed or locked position.

The pour spout 76 has a substantially circular outer surface including threads 80 for mating with threads on a cap 82 to close and seal the pour spout 76, and defines a through passage 84 in communication with the receptacle 16 and the through passage 48. The through passage 84 can have substantially circular cross-section with a circular segment removed to form a flat 86 as shown in FIG. 9. The coating material in the receptacle 16 can be poured through the pour spout 76 or the lid 42 can be removed from the end cap 40 and the coating material poured through collar 52. The pour spout 76 allows the coating material to be poured from the storage container 10 without removing the lid 42, reduces drip, and provides more control when pouring.

Turning now to the receptacle 16, the receptacle may be any suitable receptacle, such as a bag of any suitable number of layers, may be made of any suitable material, such as plastic, and may have a suitable coating such as a metallic coating. The receptacle 16 has a first open end 90 and a second closed end that is sealed to prevent leakage at the second end. The first end 90 is attached to and sealed to the an inner or outer surface of the inner skirt 56 in a suitable manner, such as by an ultrasonic weld, tape, glue, one or more tension clamps, etc. In an embodiment, the first end 90 is fitted around the inner skirt 56 in the channel 60 and ultrasonically welded to the inner skirt 56 to prevent leakage between the inner skirt and the first end 90 and to prevent air from escaping between the inner skirt 56 and the first end 90. In another embodiment, the receptacle 16 is a multiple liner bag where one liner is attached to the inner surface of the inner skirt 56 and another line is attached to the outer surface of the skirt 56, or both liners are attached to the inner or outer surface. The multiple layers may include a metallized outer layer laminated to a linear low-density polyethylene inner layer. In still another embodiment, the receptacle can have a pour spout in addition to or in place of the pour spout 76, or may be sealable in other suitable manners.

When the lid 42 is secured to the end cap 40 and the cap 82 is secured to the pour spout 76, the container 10 is sealed preventing leakage and preventing the coating material from hardening. In an embodiment, the inner surface 26 of the wall 18 presses against the receptacle 16 in the channel 60. In another embodiment, the receptacle 16 can be coupled to the container body 12 in addition to or as an alternative to the end cap 40.

Figure 10:
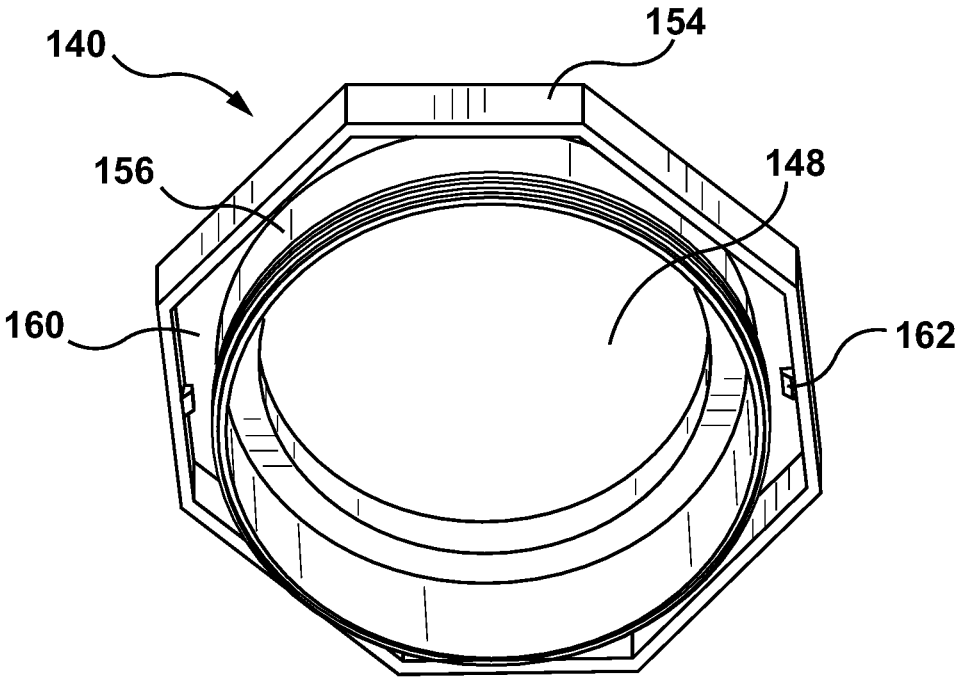
FIG. 10 is a perspective view of another embodiment of an end cap.
Figure 11:
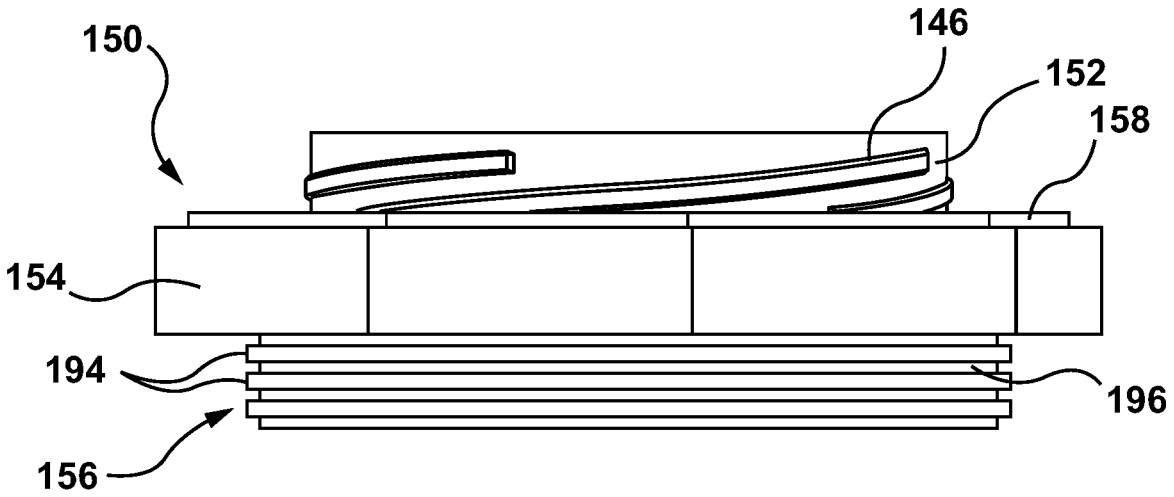
FIG. 11 is a side view of the end cap of FIG. 10.

Turning now to FIGS. 10 and 11, an exemplary embodiment of the end cap is shown at 140. The end cap 140 is substantially the same as the above-referenced end cap 40, and consequently the same reference numerals but indexed by 100 are used to denote structures corresponding to similar structures in the end caps. In addition, the foregoing description of the end cap 40 is equally applicable to the end cap 140 except as noted below.

The end cap 140 includes a base 150, a collar 152 projecting upward from the base 150 and having the threads 146 and defining a through passage 148 in communication with the receptacle, inner and outer skirts 154 and 156 extending downwards from the base 150, and a raised structure 158 extending upward from a top side of the base 150. The outer skirt 154 projects downward along a periphery of the base 150 and follows the geometry of the base 150, and the inner skirt 156 is radially inwardly spaced from the outer skirt 154 and projects downward with a substantially circular geometry. The inner skirt 156 projects downward from the collar 152 further than the outer skirt 154. In an embodiment, the inner skirt 156 has a first diameter and the collar 152 has a second diameter, where the first diameter may be larger than the second diameter as shown, equal to the second diameter, or less than the second diameter. In another embodiment the inner skirt 156 can be continuous with the collar 152.

The outer and inner skirts 154 and 156 form therebetween and with the base 150 a channel 160 for receiving the first end of the wall that may be coupled to the end cap 140 by a plurality of attachment tabs 162 projecting inward from the outer skirt 154. The inner skirt 156 includes one or more ribs 194, and in the illustrated embodiment a plurality of ribs 194 extending circumferentially around the inner skirt 156. The plurality of ribs 194 are spaced in an axial direction from one another to form channels 196 therebetween. The first end of the receptacle can be fitted around the inner skirt 156 in the channel 160 and clamped to the inner skirt 156, for example by one or more clamps, such as a tension clamp received in each channel 196. In an embodiment, the receptacle can be attached to the inner skirt 156 with a tongue and groove connection, such as by a groove on the perimeter of the bottom side of the skirt 156 in which an opening of the receptacle can be inserted and attached. The receptacle can be affixed by glue, heat fusing, molding, adhesive, or other connecting means within the groove. In another embodiment, the opening of the receptacle can include a rim or wire to provide a thickness greater than the thickness of a sidewall of the receptacle and such thick rim or wire can fit into the one of the channels 196.

Figure 13:
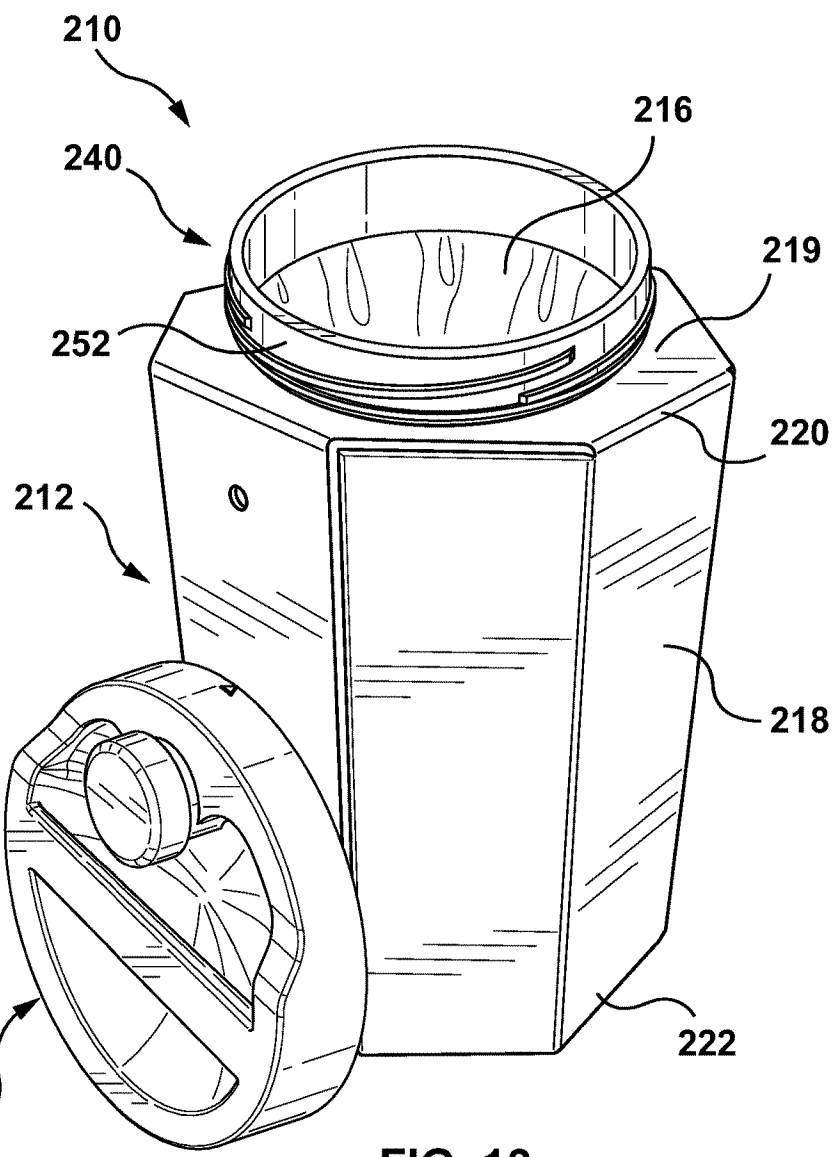
FIG. 13 is another perspective view of the storage container of FIG. 12 with a lid removed.
Figure 12:
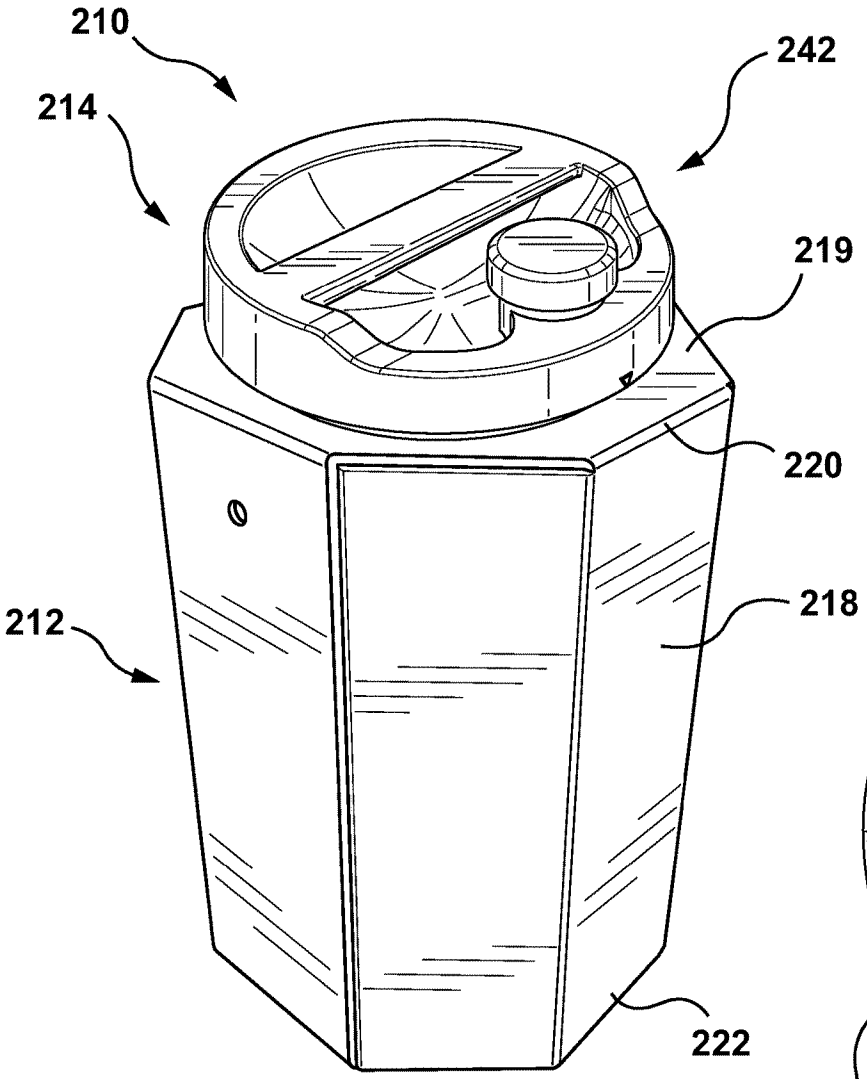
FIG. 12 is a perspective view of another embodiment of a storage container.
Figure 14:
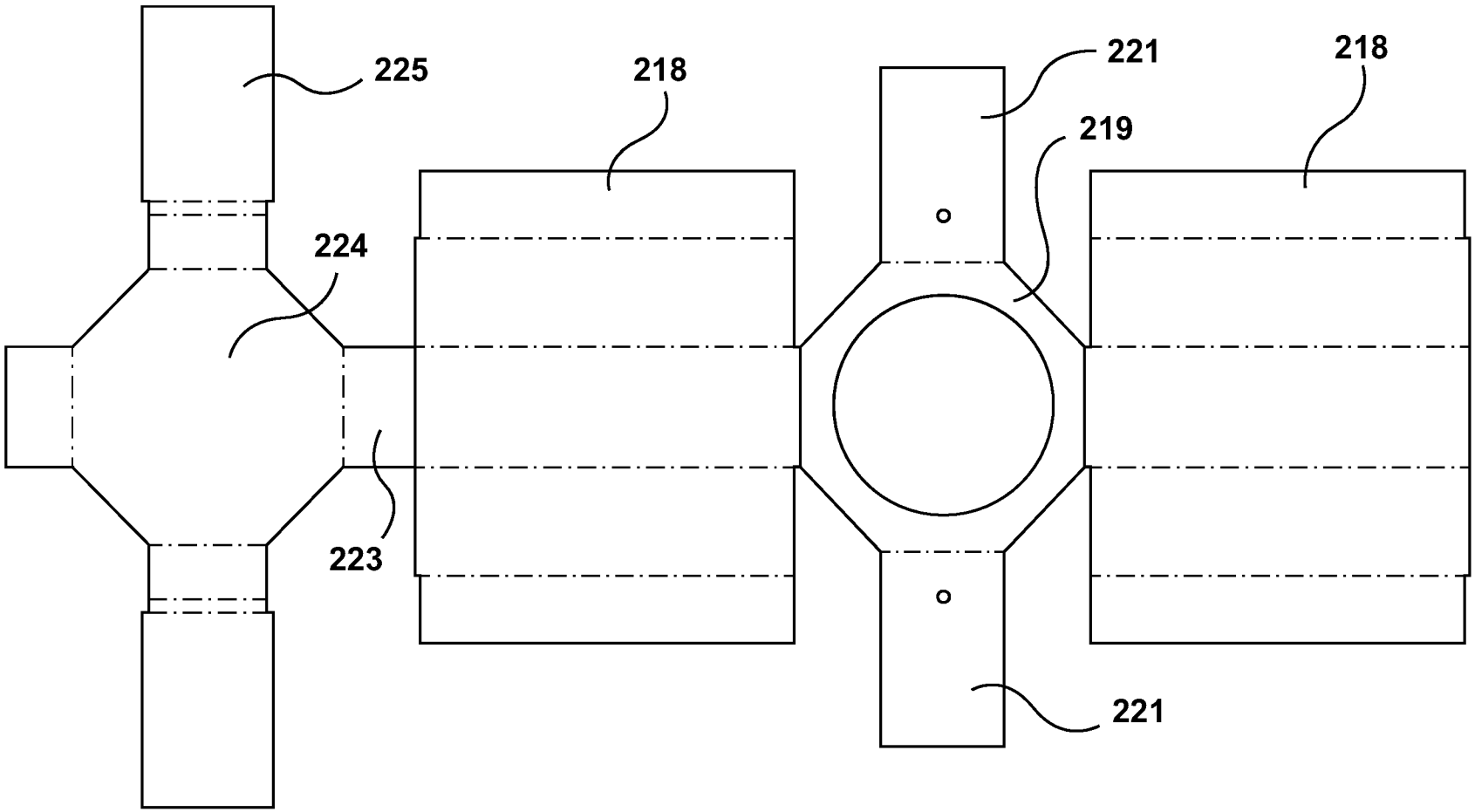
FIG. 14 is a plan view of a container body of the storage container of FIG. 12 in an unfolded state.

Turning now to FIGS. 12-14, an exemplary embodiment of the storage container is shown at 210. The storage container 210 is substantially the same as the above-referenced storage container 10, and consequently the same reference numerals but indexed by 200 are used to denote structures corresponding to similar structures in the storage containers. In addition, the foregoing description of the storage container 10 is equally applicable to the storage container 210 except as noted below.

The storage container 210 includes a container body 212, a lid assembly 214 attached to the container body 212, and a receptacle 216 attached to the lid assembly 214 or container body 212 and disposed within the container body 212. The container body 212 has a wall 218, a top portion 219 coupled to or integrally formed with the wall 218 at a first end 220, and a bottom portion 224 coupled to or integrally formed with the wall 218 proximate a second end 222 to define with an inner surface of the wall 218 a cavity. The top portion 219 includes an opening radially inwardly spaced from an edge of the top portion for a collar 252 of the lid assembly 214 or alternatively the top portion 219 defines the collar. The lid assembly 214 includes an end cap 240 and a lid 242 removably coupled to the end cap 240. The end cap 240 includes a base and the collar 252 projecting upward from the base, or alternatively the collar 252 can be coupled to the top portion 219. The end cap 240 may optionally include one or more skirts as discussed above.

Referring to FIG. 14, an unassembled container body 212 is shown. The wall 218 is separated into two portions that include panels that overlap with one another to form the eight sided body 212. The portions of the wall 218 are attached to two sides of the top portion 219 at the first end 220, and supports 221 are attached to two other sides of the top portion 219 and configured to be secured to an inner or outer surface of the wall 218. One of the portions of the wall 218 is also attached to a spacer 223 at the second end 222, and the spacer is also attached to the bottom portion 224. When assembled, the spacer 223, and optional second spacer, abuts the inner surface of the wall 218 to space the bottom portion 224 from the second end 222 to form the cavity 228. Supports 225 can also be attached to two sides of the bottom portion 224 and configured to be secured to the inner surface of the wall 218.

Figure 15:
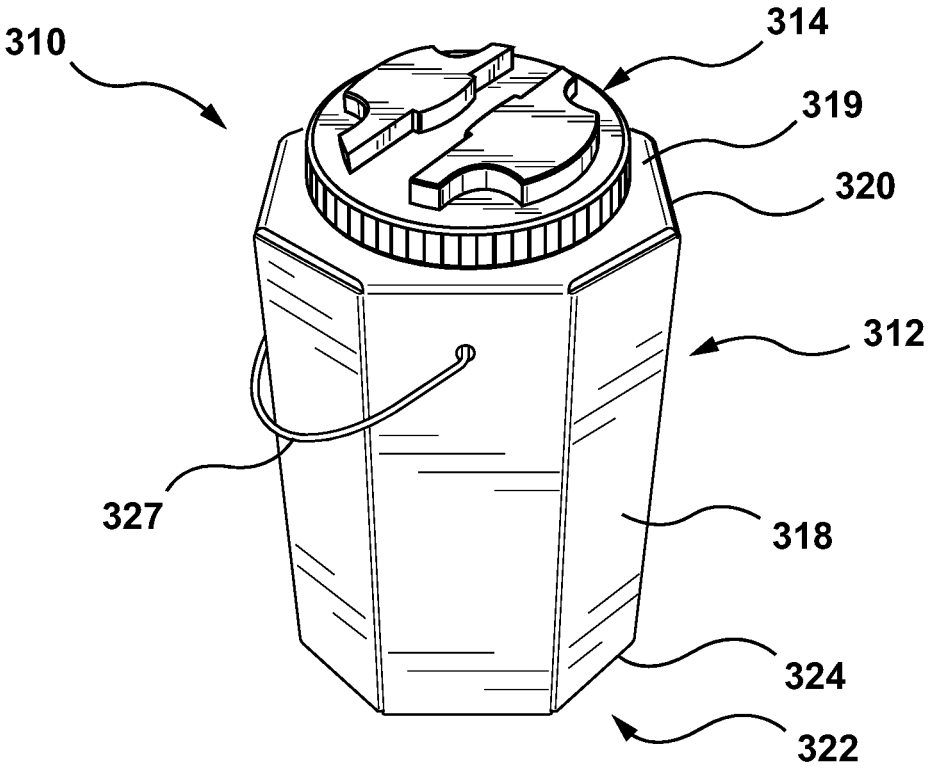
FIG. 15 is a perspective view of another embodiment of a storage container.
Figure 16:
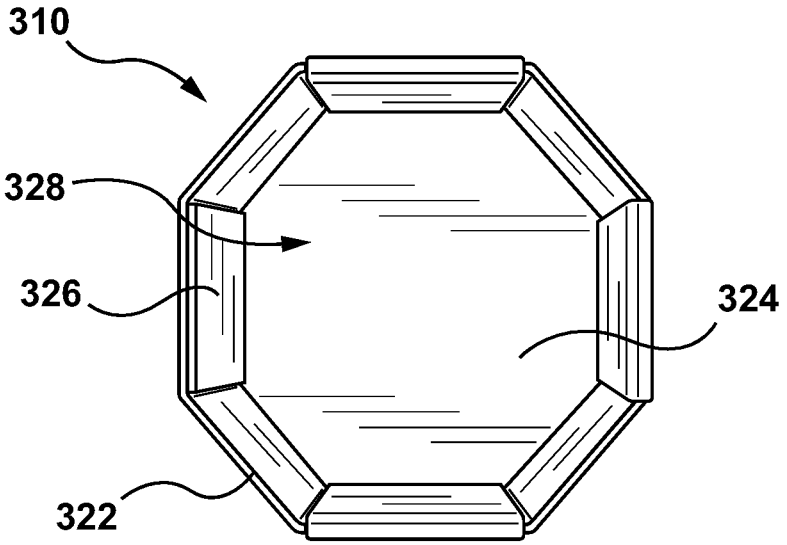
FIG. 16 is a bottom view of the storage container of FIG. 15.
Figure 17:
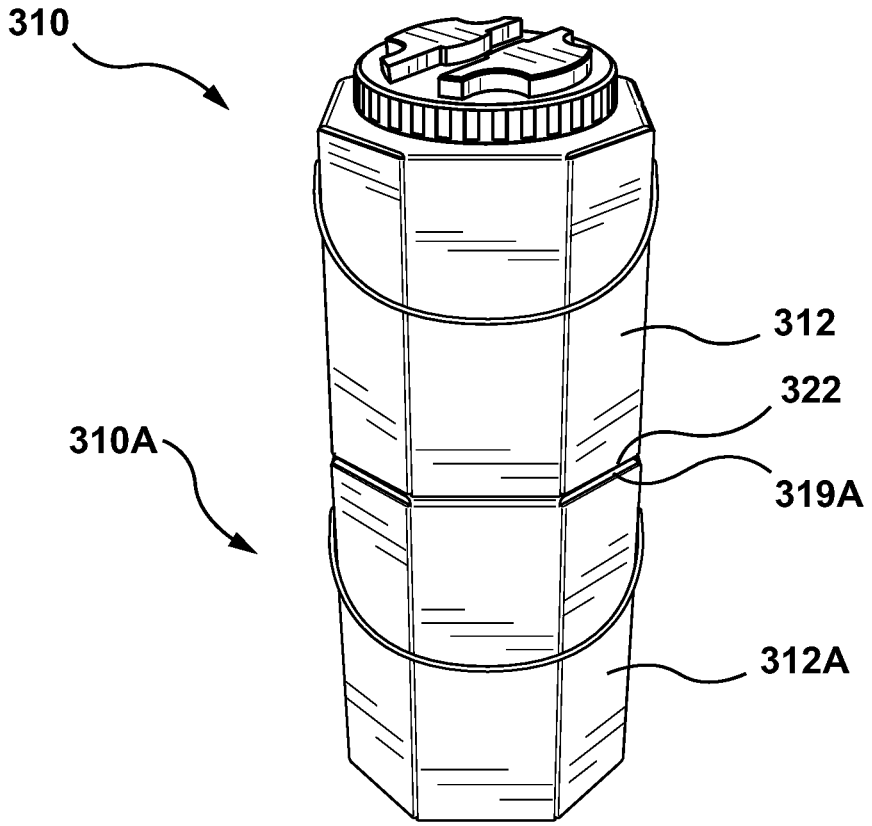
FIG. 17 is a perspective view of the storage container of FIG. 15 stacked on another storage container.

Turning now to FIGS. 15-17, an exemplary embodiment of the storage container is shown at 310. The storage container 310 is substantially the same as the above-referenced storage container 10, and consequently the same reference numerals but indexed by 300 are used to denote structures corresponding to similar structures in the storage containers. In addition, the foregoing description of the storage container 10 is equally applicable to the storage container 310 except as noted below.

The storage container 310 includes a container body 312, a lid assembly 314 attached to the container body 312, and a receptacle (not shown) attached to the lid assembly 314 or container body 312 and disposed within the container body 312. The container body 312 has a wall 318, a top portion 319 coupled to or integrally formed with the wall 318 at a first end 320, and a bottom portion 324 coupled to or integrally formed with the wall 318 proximate a second end 322 to define with an inner surface 326 of the wall 318 a cavity 328. The top portion 319 includes an opening radially inwardly spaced from an edge of the top portion for a collar (not shown) of the lid assembly 314 or alternatively the top portion 319 defines the collar.

The lid assembly 314 includes an end cap (not shown) and a lid 342 removably coupled to the end cap. The end cap can include a base and the collar projecting upward from the base, or alternatively the collar can be coupled to the top portion 319. The end cap may optionally include one or more skirts as discussed above. A bail-type handle 327 may be attached to the wall 318 of the container body 312 in any suitable manner such that the handle 327 rests against the wall 318 in its normal state and is movable away from the wall 318 and above the lid 342 to carry the storage container 310 in its carrying state.

As shown in FIG. 16, the recess or cavity 328 facilitates stacking or nesting of containers as shown in FIG. 17 and provides a lip around the edge at the second end 322 serving as a grip to aid in pouring and eliminate the need for die cut handles. When the container 310 is stacked on a container 310A, the lid of the container 310A is received in the recess 328 of the container 310 and the second end 322 of the container body 312 abuts a top portion 319A of the container body 312A. The recessed design allows for more functionality without increasing the size of the container.

Referring now to FIGS. 18-24, exemplary embodiments of the lid are shown at 442, 542, 642, 742, and 842 respectively. The lids are substantially the same as the above-referenced lid 42, and consequently the same reference numerals but indexed by 400, 500, 600, 700, and 800 respectively are used to denote structures corresponding to similar structures in the lid.

Figure 18:
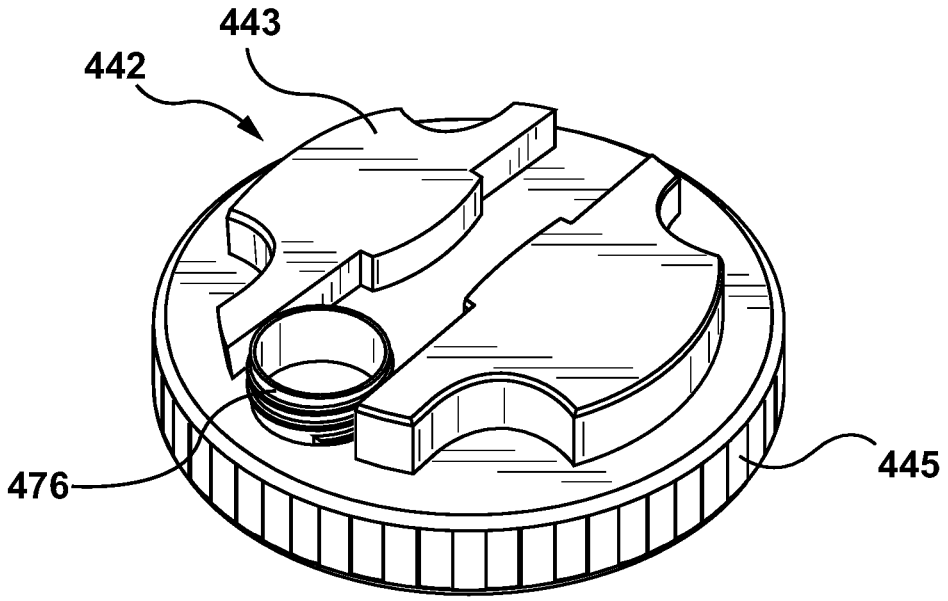
FIG. 18 is a perspective view of another embodiment of a lid.

Turning now to FIG. 18, an embodiment of the lid is illustrated at 442. The lid 442 may be circular in shape and include a raised pour spout 476, raised grip portions 443 extending upward from the lid 442, and spaced raised portions 445 around its periphery to assist in gripping the lid for removal and tightening.

Figure 19:
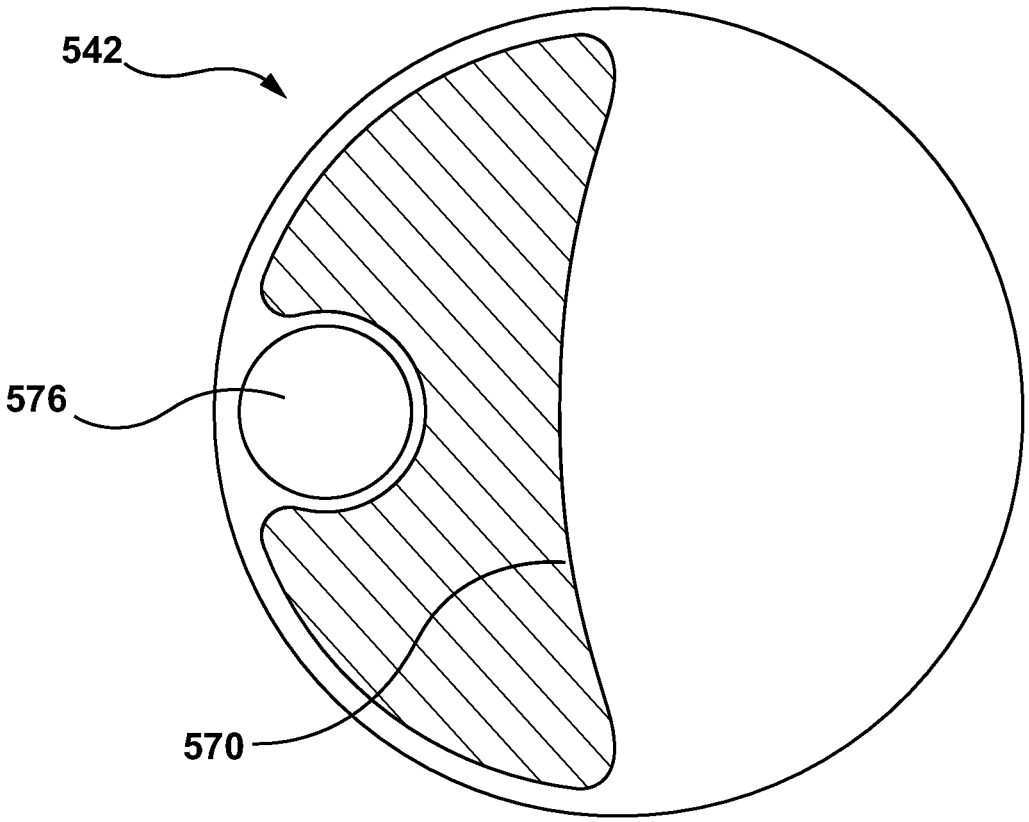
FIG. 19 is a top view of still another embodiment of a lid.
Figure 20:
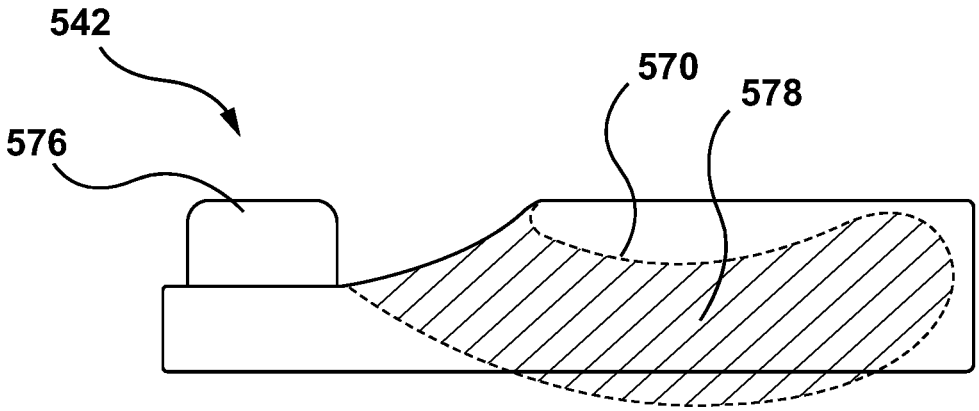
FIG. 20 is a side view of the lid of FIG. 19.

Turning now to FIGS. 19 and 20, yet another embodiment of the lid is illustrated at 542. The lid 542 is circular in shape and includes a pour spout 576 and a handle 570 for carrying the container. A cavity 578 is defined in the lid 542 forming a hand shaped grip area that serves as the handle 570.

Figure 21:
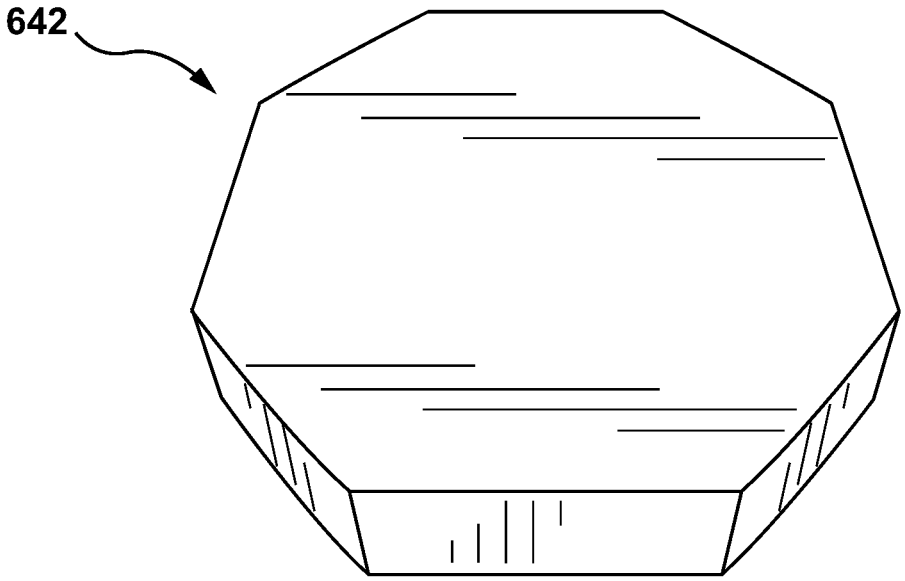
FIG. 21 is a perspective view of yet another embodiment of a lid.
Figure 22:
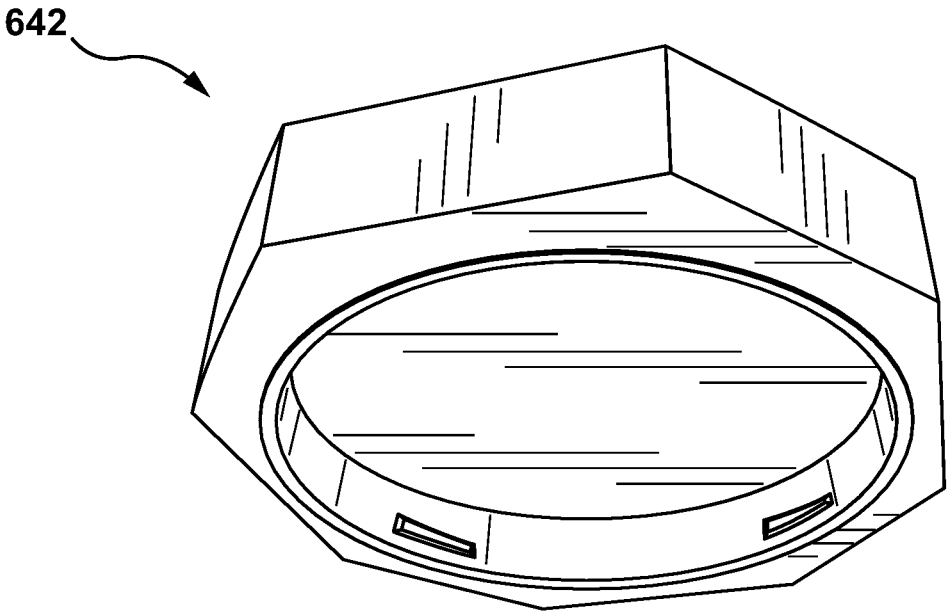
FIG. 22 is another perspective view of the lid of FIG. 21.

Turning now to FIGS. 21 and 22, still another embodiment of the lid is illustrated at 642. The lid is polygonal in shape, and in the illustrated embodiment octagonal in shape. The octagonal shape of the lid aligns to the edges of the container body for closure confirmation. The perimeter of the lid may define the area upon which the bottom of another container abuts when stacked.

Figure 23:
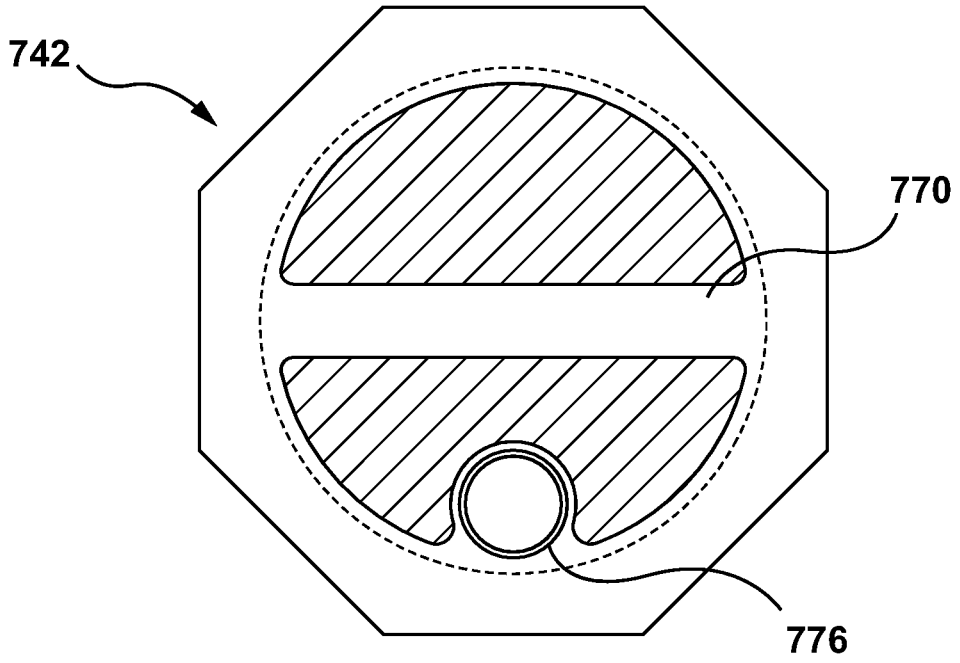
FIG. 23 is a top view of a further embodiment of a lid.

Turning now to FIG. 23, a further embodiment of the lid is illustrated at 742. The lid 742 is substantially the same as the lid 42, including the pour spout 776 and handle 770, except the lid is polygonal in shape, and in the illustrated embodiment octagonal in shape. The octagonal shape of the lid aligns to the edges of the box for closure confirmation. The perimeter of the lid may define the area upon which the bottom of another container abuts when stacked.

Figure 24:
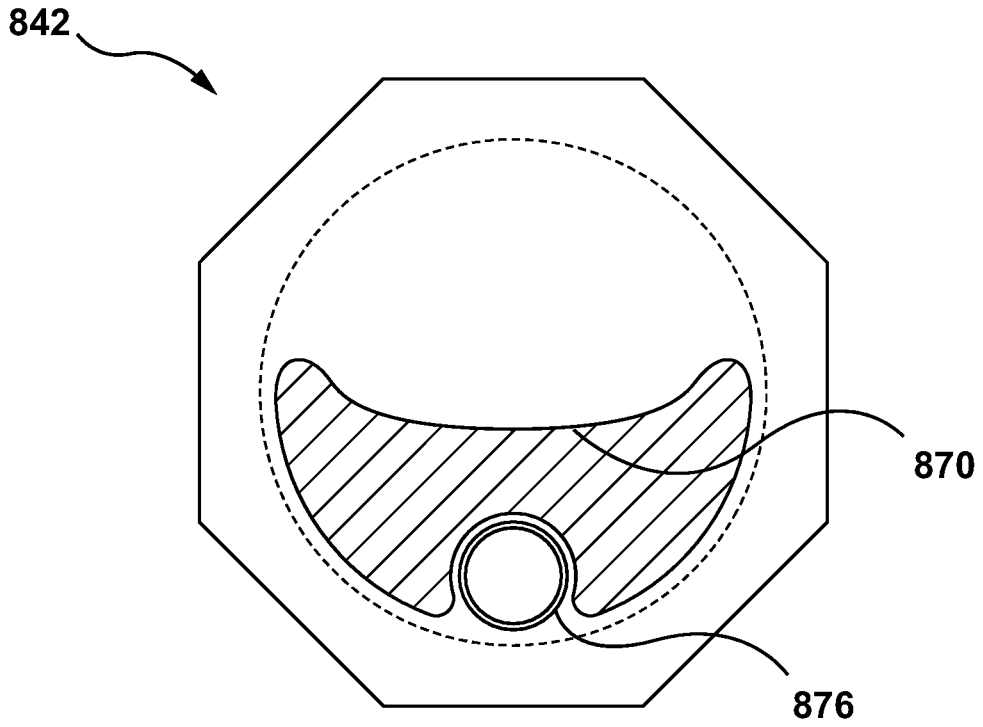
FIG. 24 is a top view of another embodiment of a lid.
Figure 26:
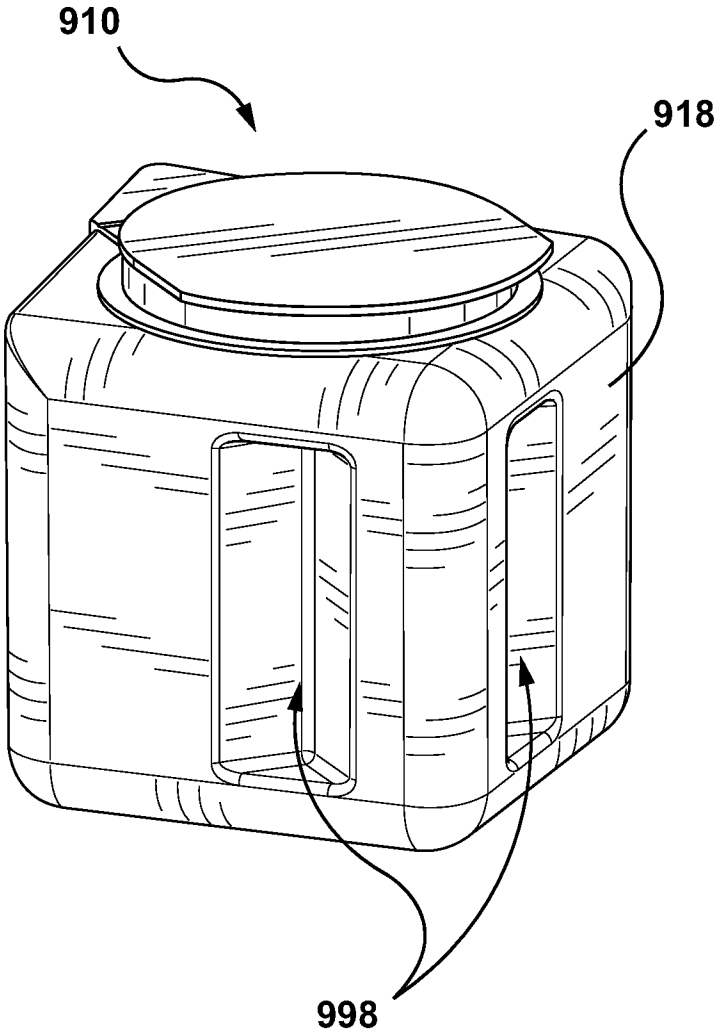
FIG. 26 is another perspective view of the storage container of FIG. 25.
Figure 25:
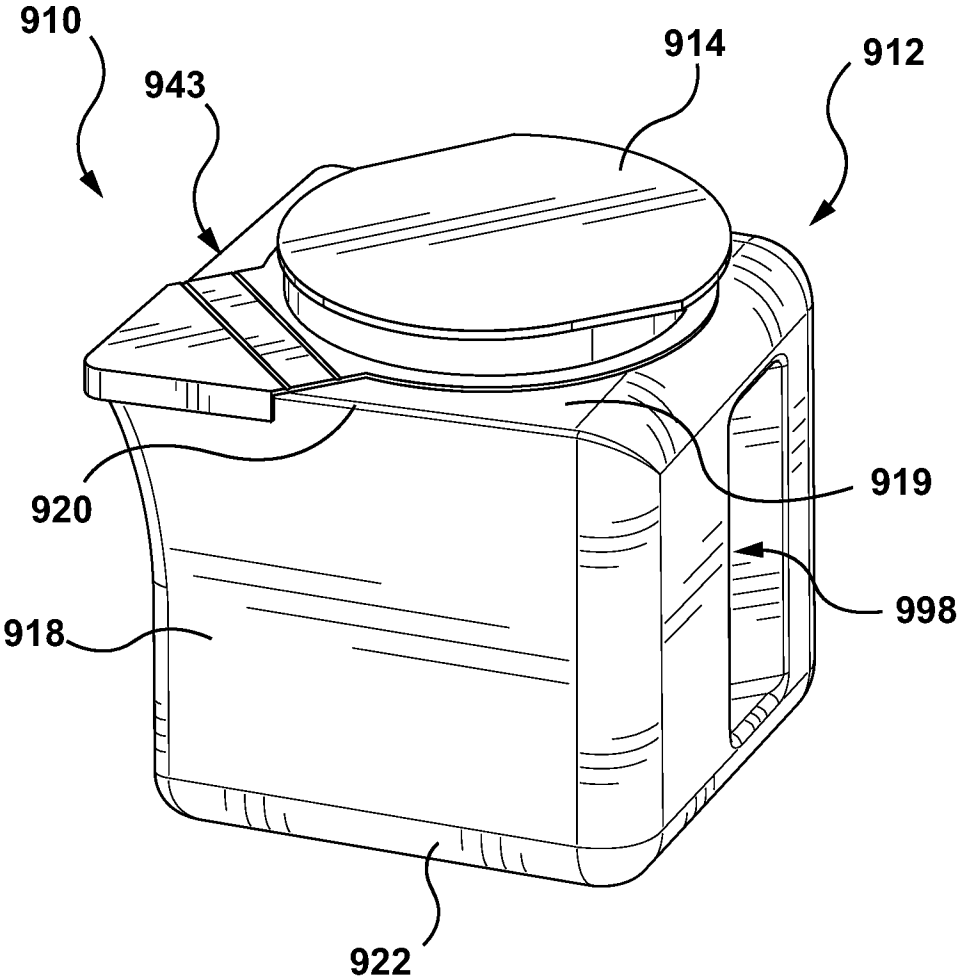
FIG. 25 is a perspective view of still another embodiment of a storage container.

Turning now to FIG. 24, a further embodiment of the lid is illustrated at 842. The lid is substantially the same as the lid 542, including the pour spout 876 and handle 870, except the lid is polygonal in shape, and in the illustrated embodiment octagonal in shape. The octagonal shape of the lid aligns to the edges of the box for closure confirmation. The perimeter of the lid may define the area upon which the bottom of another container abuts when stacked.

Turning now to FIGS. 25-28, an exemplary embodiment of the storage container is shown at 910. The storage container 910 is substantially the same as the above-referenced storage container 10, and consequently the same reference numerals but indexed by 900 are used to denote structures corresponding to similar structures in the storage containers. In addition, the foregoing description of the storage container 10 is equally applicable to the storage container 910 except as noted below.

The storage container 910 includes a container body 912 and a lid assembly 914 removably coupled to the container body 912, such as by a snap connection. The container body 912 includes a wall 918, shown as a four sided wall, a top portion 919 at a first end 920, and a bottom portion (not shown) at a second end 922. The wall 918 includes at least one recessed portion 998, and in the illustrated embodiment a pair of recessed portions 998 that serve as textured finger grip areas. One of the recessed portions 998 is provided on one of the sides of the wall 918 and one of the recessed portions 998 is provided on another of the sides of the wall 918, where the sides are adjacent one another and the recessed portions 998 are provided near the same corner of the wall 918. It will be appreciated that a bail-type handle may additionally or alternatively be provided.

Figure 28:
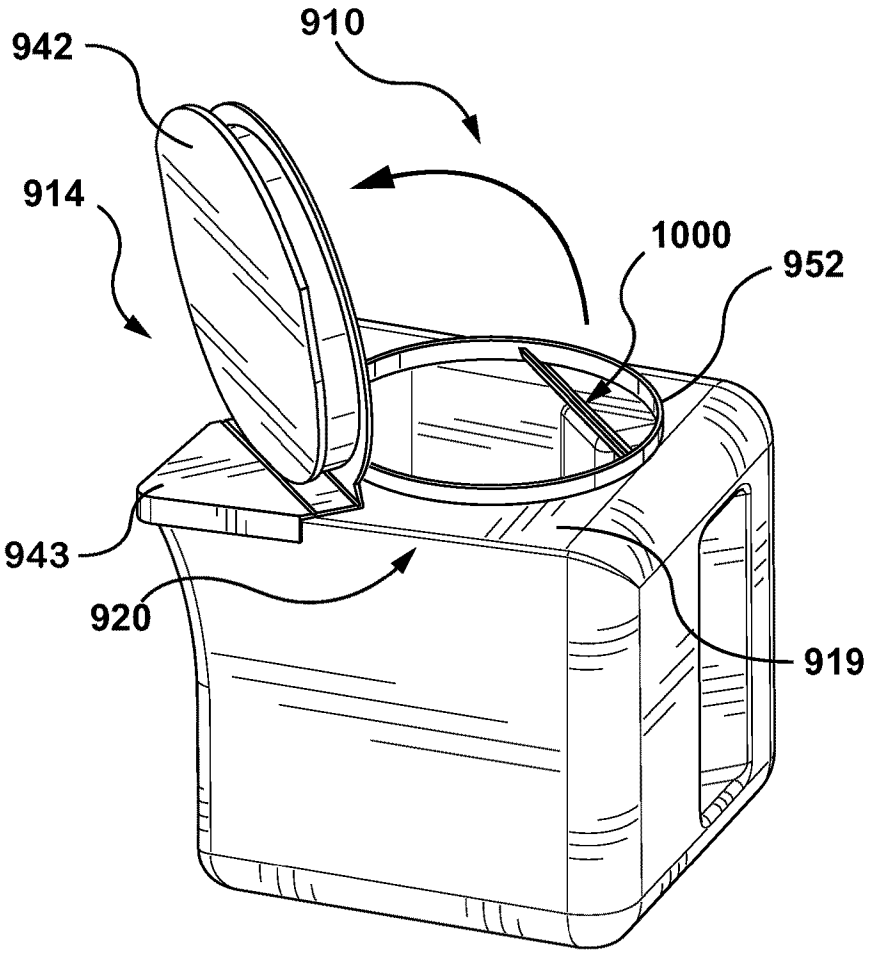
FIG. 28 is another perspective view of the storage container of FIG. 25 with a first lid open.
Figure 27:
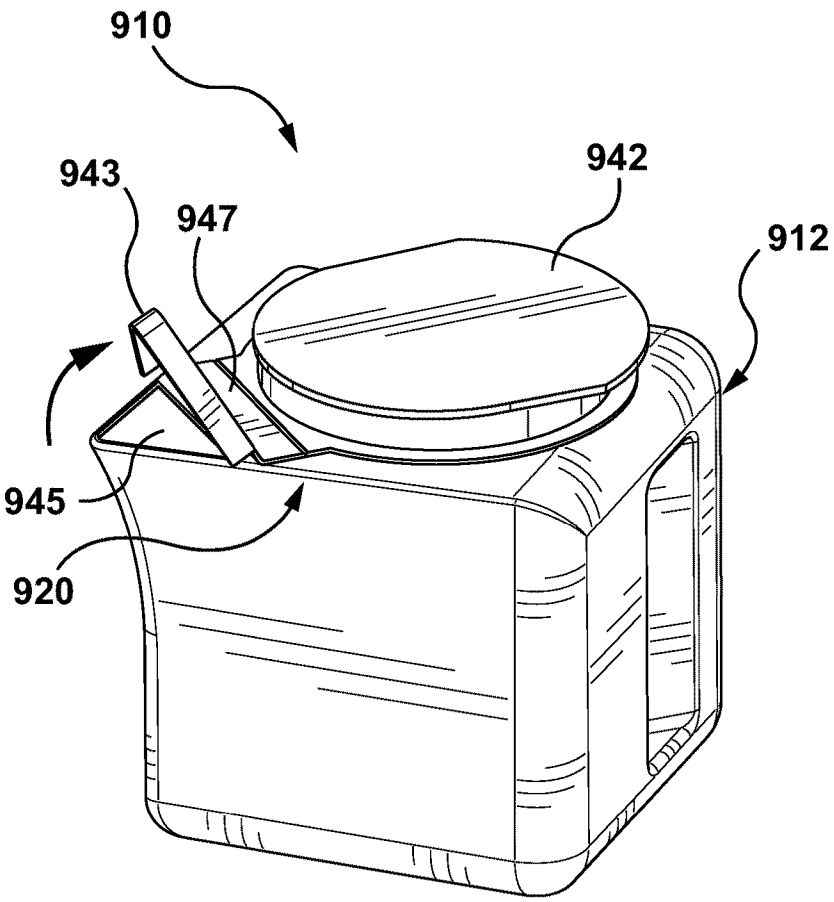
FIG. 27 is another perspective view of the storage container of FIG. 25 with a second lid open.

As shown in FIGS. 27 and 28, the container body 912 includes a collar 952 at the first end 920 extending upward from the top portion 919 defining a through passage into the container body 912. A paint brush wipe bar 1000 may be attached to the collar 952 or integrally formed with the collar. The lid assembly 914 includes a first lid 942 that snaps on/off the collar 952 to seal the through passage and a second lid 943 that snaps on/off a corner of the top portion 919 to cover an opening 945 in the top portion 919. The lid assembly 914 may be a one-piece lid having a living hinge 947 connecting the first lid 942 and the second lid 943 to allow the lids 942 and 943 to hinge separately. Although not shown, a tear away plastic lock may be provided on or around the lid assembly 914 for after use in a paint shaker.

The container body 912 may be filled with a coating material or may enclose a receptacle filled with coating material. The container body 912 may be made out of any suitable material, such as cardboard, plastic, metal, etc., and the lid assembly 914 may be made out of any suitable material, such as plastic. The container body 912 may include a recessed bottom for stacking similar to the storage container 10 or 310.

Figure 29:
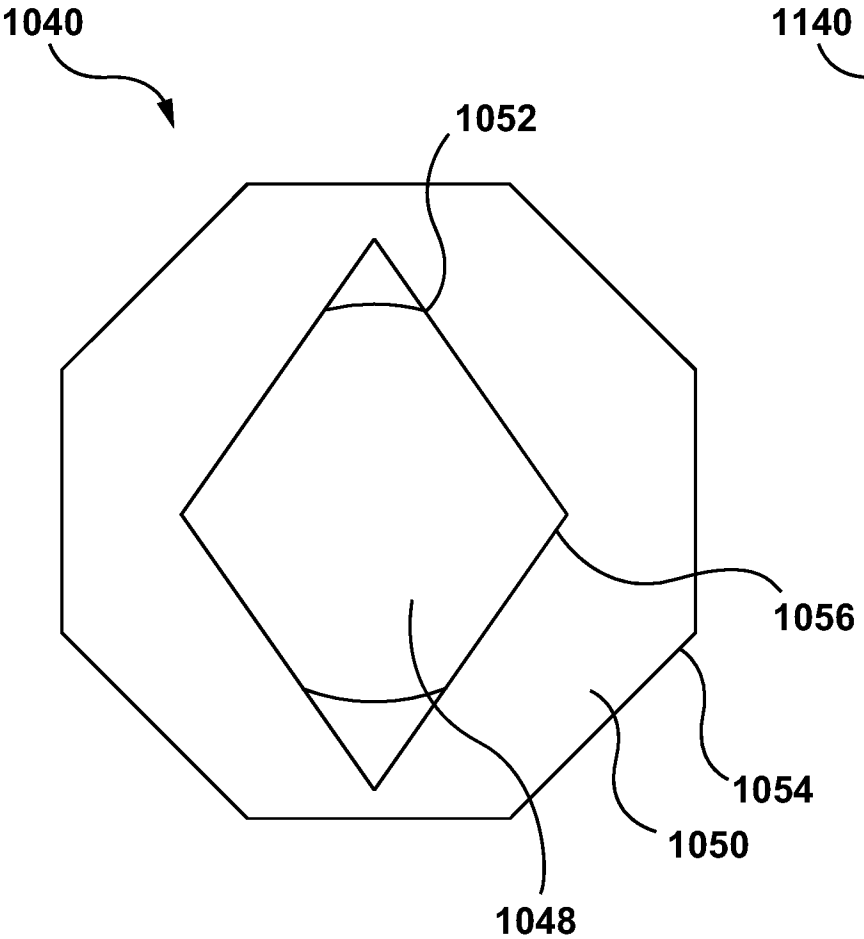
FIG. 29 is a bottom view of another embodiment of an end cap.

Turning now to FIG. 29, an exemplary embodiment of the end cap is shown at 1040. The end cap 1040 is substantially the same as the above-referenced end cap 40, and consequently the same reference numerals but indexed by 1000 are used to denote structures corresponding to similar structures in the end caps. In addition, the foregoing description of the end cap 40 is equally applicable to the end cap 1040 except as noted below.

The end cap 1040 includes a base 1050, a collar 1052 projecting upward from the base 1050 and defining a through passage 1048 in communication with the receptacle, and outer and inner skirts 1054 and 1056 extending downwards from the base 1050. The outer skirt 1054 projects downward along a periphery of the base 1050 and follows the geometry of the base 1050, and the inner skirt 1056 is radially inwardly spaced from the outer skirt 1054 and projects downward with a substantially rhombus shaped geometry or other suitable geometry that has pointed ends providing sealing surfaces for the receptacle.

Figure 30:
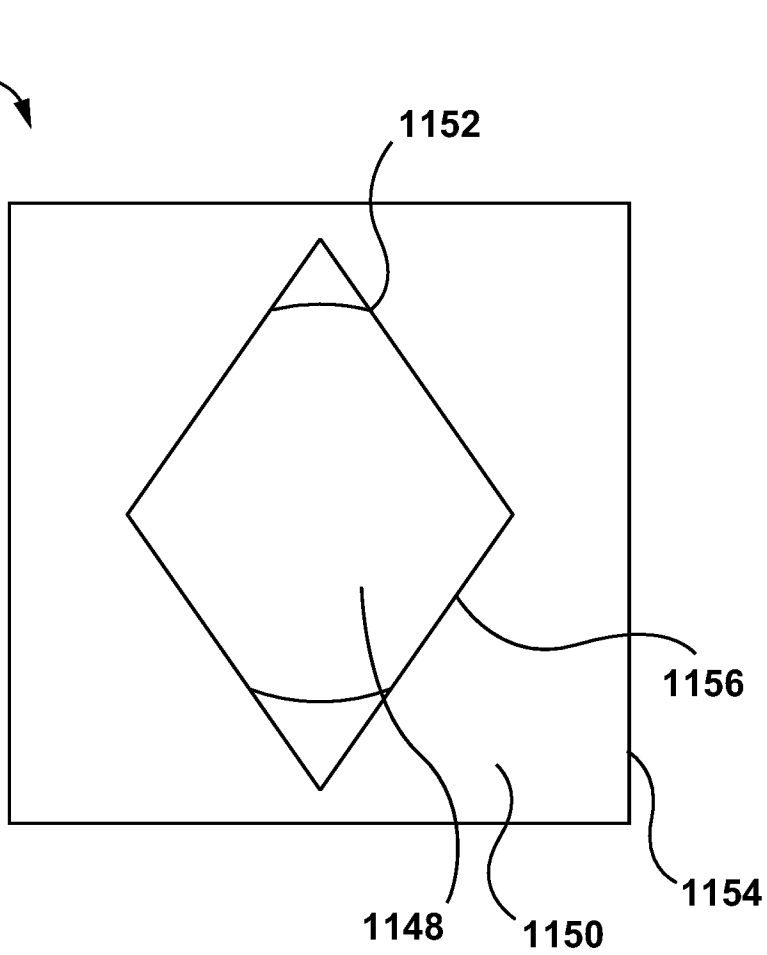
FIG. 30 is a bottom view of yet another embodiment of an end cap.

Turning now to FIG. 30, an exemplary embodiment of the end cap is shown at 1140. The end cap 1140 is substantially the same as the above-referenced end cap 40, and consequently the same reference numerals but indexed by 1100 are used to denote structures corresponding to similar structures in the end caps. In addition, the foregoing description of the end cap 40 is equally applicable to the end cap 1140 except as noted below.

The end cap 1140 includes a base 1150, a collar 1152 projecting upward from the base 1150 and defining a through passage 1148 in communication with the receptacle, and outer and inner skirts 1154 and 1156 extending downwards from the base 1150. The outer skirt 1154 projects downward along a periphery of the base 1150 and follows the geometry of the base 1150 and the container body, and the inner skirt 1156 is radially inwardly spaced from the outer skirt 1154 and projects downward with a substantially rhombus shaped geometry or other suitable geometry that has pointed ends providing sealing surfaces for the receptacle.

An opening of the storage containers 10-1110 can include an additional layer of sealing such openings after being filled with contents that are housed by the storage containers. For example, a sealed tamper device can be used under the lids and/or pour spout caps, wherein the sealed tamper device can be removed by a user before being able to access the contents housed in the storage container.

The storage containers can store, house, hold, or contain any suitable solid, liquid, gas, vapor, or a combination thereof. The storage containers can include multiple chambers inside the storage containers. For example, a first internal chamber can be separated from a second internal chamber, wherein the first internal chamber uses a first opening for access and the second internal chamber uses a second opening for access. For example, a first material can be contained in the first chamber and a second material can be contained in the second chamber to allow separation of the two materials. In another example, the two materials can be related to one another such that one chamber can be a first material and the second is a second material, wherein the first material is dependent or used with the second material or vice versa. For instance, the combination of materials can be, but are not limited to, a primer and a paint, a first paint color and a second paint color related to a design-specific color coordination, a first chemical and a second chemical that create a glue when combined, a first chemical and a second chemical that create a chemical peal or remover, among others.

The aforementioned elements (e.g., container bodies, lid assemblies, among others), and the like have been described with respect to interaction between several components and/or elements. It should be appreciated that such elements can include those elements or sub-elements specified therein, some of the specified elements or sub-elements, and/or additional elements. Further yet, one or more elements and/or sub-elements may be combined into a single component to provide aggregate functionality. The elements may also interact with one or more other elements not specifically described herein.

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify a quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Moreover, unless specifically stated otherwise, a use of the terms "first," "second," etc., do not denote an order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

This written description uses examples to disclose the subject matter, including the best mode, and also to enable one of ordinary skill in the art to practice the invention, including making and using a devices or systems and performing incorporated methods. The patentable scope of the invention is defined by the claims, and may include other examples that occur to one of ordinary skill in the art. Such other examples are intended to be within the scope of the claims if they have structural elements that do not differentiate from the literal language of the claims, or if they include equivalent structural elements with insubstantial differences from the literal language of the claims.

What is claimed is:

1. A storage container for storing a coating material, comprising:

a container body having a polygonal shape;

a receptacle disposed within the container body;

a lid assembly attached to the container body and including an end cap and a lid with threads along an interior surface that is removably coupled to the end cap, wherein the end cap includes a base having a polygonal shape, a circular collar projecting upward from the base in a first direction defining a through passage in communication with the receptacle and including threads along an exterior of the collar to mate with the threads along the interior surface of the lid to removably couple the lid to the collar, and one or more skirts extending downward from the base in a second direction opposite the first direction, and wherein the lid includes a body, a carrying handle integrally formed with the body extending from a top surface of the body in a third direction perpendicular to the first and second directions and having top and bottom surfaces, and a pour spout projecting upward from the body in the first direction and defining a through passage in communication with the through passage of the circular collar and the receptacle; and a cap removably coupled to the pour spout via threads on an inner surface thereof that mate with threads on an outer surface of the pour spout, wherein the cap is at or above a height of the carrying handle when the cap is coupled to the pour spout, wherein a cavity is formed below the carrying handle between a lower surface of the lid and an upper surface of the lid for receiving a user's hand below the bottom surface of the handle to allow a user's hand to grip the top and bottom surfaces of the carrying handle, and wherein the base includes a raised structure on a top side thereof having a polygonal shape and extending around the base, and wherein the raised structure is inwardly spaced from an edge of the base and the collar is inwardly spaced from the raised structure.

2. The storage container according to claim 1, wherein the carrying handle is in a fixed position relative to the pour spout.

3. The storage container according to claim 1, wherein the lid additionally includes an alignment marker that aligns with a corresponding alignment marker on the base of the end cap when the lid is in a closed position.

4. The storage container according to claim 1, wherein the container body includes a multiple sided wall having a first end coupled to the end cap, a second end, and the multiple sided wall defines a cavity for the receptacle.

5. The storage container according to claim 4, wherein the container body additionally includes a bottom portion in the cavity proximate the second end and defining with an inner surface of the multiple sided wall a stacking cavity for receiving a lid assembly of another container during stacking.

6. The storage container according to claim 1, wherein the one or more skirts includes an outer skirt extending downward in the second direction along a periphery of the base and an inner skirt radially inwardly spaced from the outer skirt and projecting downward from the base in the second direction, and wherein the outer and inner skirts form therebetween and with the base a channel for receiving an end of the container body.

7. The storage container according to claim 6, wherein the outer and inner skirts follow the geometry of the base.

8. The storage container according to claim 6, wherein the outer skirt follows the geometry of the base and the inner skirt has a substantially rhombus shaped geometry.

9. The storage container according to claim 6, wherein the outer skirt follows the geometry of the base and the inner skirt has a substantially circular geometry.

10. The storage container according to claim 9, wherein the inner skirt includes a plurality of circumferential ribs extending around the inner skirt that are spaced along the inner skirt from one another to form channels therebetween.

11. The storage container according to claim 6, further including a plurality of attachment tabs projecting inward from the outer skirt into the channel that bite into an outer surface of the container body to secure the end cap to the container body.

12. The storage container according to claim 6, wherein the receptacle is a storage bag having an open end attached to and sealed to the inner skirt and a closed end opposite the open end.

13. A storage container for storing a coating material, comprising:

a container body having first and second ends and a polygonal shape;

a receptacle disposed within the container body;

an end cap attached to the container body at the first end and having a polygonal shape corresponding to the polygonal shape of the container body, the end cap including a base, a circular collar projecting upward from the base in a first direction that defines a through passage in communication with the receptacle, and a raised structure projecting upward from the base in the first direction having a polygonal shape corresponding to the polygonal shape of the base and extending around the base, the raised structure being inwardly spaced from an edge of the base and outwardly spaced from the circular collar;

a lid removably coupled to the circular collar of the end cap, the lid including a carrying handle integrally formed with the lid extending in a second direction perpendicular to the first direction, the handle having a top surface and a bottom surface, and a pour spout adjacent an edge of the lid that defines a through passage in communication with the through passage of collar and the receptacle, wherein a cavity is formed below the handle between a lower surface of the lid and an upper surface of the lid for receiving a user's hand below the bottom surface of the handle to allow a user's hand to grip the top and bottom surfaces of the carrying handle, and wherein the handle is in a fixed position relative to the pour spout.

14. The storage container according to claim 13, wherein the end cap further includes outer and inner skirts extending downward from the base in a third direction opposite the first direction, wherein the outer skirt extends along a periphery of the base and the inner skirt is radially inwardly spaced from the outer skirt, and wherein the outer and inner skirts form therebetween and with the base a channel for receiving the first end of the container body.

15. The storage container according to claim 14, further including a plurality of attachment tabs projecting inward from the outer skirt into the channel that bite into an outer surface of the container body to secure the end cap to the container body.

16. The storage container according to claim 14, wherein the receptacle is a storage bag having an open end attached to and sealed to the inner skirt and a closed end opposite the open end.

17. The storage container according to claim 13, wherein the container body includes a multiple sided wall having a first end coupled to the end cap, a second end, and the multiple sided wall defines a cavity for the receptacle.

* * * * *